US008187123B2

(12) United States Patent
Pettys et al.

(10) Patent No.: US 8,187,123 B2
(45) Date of Patent: May 29, 2012

(54) PORTABLE TARGET TO ENABLE AN INDIVIDUAL TO PRACTICE KICKING SOCCER BALLS THROUGH WHAT IS CONSIDERED THE MOST DIFFICULT LOCATION FOR A GOAL TENDER TO GUARD AGAINST

(76) Inventors: Jeffrey C. Pettys, Pasadena, CA (US); Duncan E. Oughton, Columbus, OH (US)

( * ) Notice: Subject to any disclaimer, the term of this patent is extended or adjusted under 35 U.S.C. 154(b) by 135 days.

(21) Appl. No.: 12/806,642

(22) Filed: Aug. 18, 2010

(65) Prior Publication Data

US 2012/0046133 A1 Feb. 23, 2012

(51) Int. Cl.
*A63B 69/00* (2006.01)

(52) U.S. Cl. ..... 473/446; 273/402

(58) Field of Classification Search ..... 273/398–402, 273/127 D, 127 R; 473/446, 454, 439, 422, 473/476–478, 470, 471; 116/173, 174
See application file for complete search history.

(56) References Cited

U.S. PATENT DOCUMENTS

| | | | | |
|---|---|---|---|---|
| 61,383 | A | 11/1898 | Morgan | |
| 2,647,742 | A | 8/1953 | Kenney et al. | |
| 3,471,153 | A * | 10/1969 | Baumler | 273/359 |
| 4,245,843 | A | 1/1981 | Griggs | |
| 4,295,648 | A | 10/1981 | Stromback | |
| 4,826,166 | A | 5/1989 | Baker et al. | |
| 4,842,283 | A | 6/1989 | LeBel et al. | |
| D303,824 | S | 10/1989 | Maloney, II | |
| 4,921,257 | A * | 5/1990 | Heller | 473/446 |
| 4,948,147 | A | 8/1990 | Pallanca | |
| 4,984,809 | A | 1/1991 | Chiang | |
| 5,181,725 | A | 1/1993 | Leras et al. | |
| 5,271,624 | A * | 12/1993 | Sciortino | 473/446 |
| 5,503,402 | A * | 4/1996 | Moss, Jr. | 273/400 |
| 5,634,640 | A * | 6/1997 | McCarrel | 473/446 |
| 5,725,444 | A * | 3/1998 | Heden | 473/446 |
| 5,888,153 | A | 3/1999 | Masin | |
| 5,928,093 | A * | 7/1999 | Lai | 473/430 |
| 6,068,488 | A * | 5/2000 | Sinsheimer et al. | 434/251 |
| 6,209,876 | B1 | 4/2001 | Franklin | |
| 6,402,641 | B1 | 6/2002 | Lee | |
| 6,508,729 | B1 | 1/2003 | Coltrane et al. | |
| 6,692,384 | B2 | 2/2004 | Bains | |
| 7,134,976 | B1 | 11/2006 | Smith | |
| D537,489 | S | 2/2007 | McAdams et al. | |
| 7,252,604 | B2 | 8/2007 | Birss | |
| 7,407,452 | B1 * | 8/2008 | Gawthrop | 473/446 |
| 7,661,679 | B2 | 2/2010 | Mah et al. | |
| 8,052,545 | B1 * | 11/2011 | Assenheimer, III | 473/446 |
| 2002/0042312 | A1 * | 4/2002 | Decloux | 473/476 |
| 2002/0111234 | A1 | 8/2002 | MacNichol | |
| 2007/0265115 | A1 * | 11/2007 | Farquhar | 473/446 |

(Continued)

*Primary Examiner* — Mark Graham
(74) *Attorney, Agent, or Firm* — Thomas I. Rozsa

(57) ABSTRACT

A portable target for a soccer goal designed with rods that enable an individual to stand on the ground and lift the portable target so that it can be lifted over the top horizontal crossbar of the soccer goal and then set in place. The target has elongated rods with curved hook attaching members designed in a manner that enables an individual to stand on the ground and simply lift the target so that the curved hook attaching members can be extended over the top horizontal crossbar of a soccer goal and then lowered onto the top horizontal crossbar of a soccer goal to be removably affixed thereto. The rod are removably retained within interior channels within the target.

12 Claims, 6 Drawing Sheets

U.S. PATENT DOCUMENTS

2008/0076606 A1* 3/2008 Siefker ..... 473/446
2008/0214331 A1* 9/2008 Talafous et al. ..... 473/446
2008/0272548 A1 11/2008 Hensley
2009/0036238 A1* 2/2009 Sheehan ..... 473/446
2009/0176603 A1 7/2009 Prince
2009/0181810 A1* 7/2009 Stephenson ..... 473/446

* cited by examiner

PORTABLE TARGET TO ENABLE AN INDIVIDUAL TO PRACTICE KICKING SOCCER BALLS THROUGH WHAT IS CONSIDERED THE MOST DIFFICULT LOCATION FOR A GOAL TENDER TO GUARD AGAINST

BACKGROUND OF THE INVENTION

1. Field of the Invention

The present invention relates to the field of portable soccer goal targets which can be removably affixed to a soccer goal at given locations to enable an individual to practice kicking a soccer ball through the soccer goal at specific desired locations.

2. Detailed Description of the Prior Art

In general the concept of having targets affixed to soccer goals or other types of athletic structures is known. The following 23 patents and published patent applications are relevant.

1. U.S. Pat. No. 613,383 issued to Anne E. Morgan on Nov. 1, 1898 for "Game Apparatus" (hereafter the "Morgan patent");

2. U.S. Pat. No. 2,647,747 issued to Harold E. Kenney et al. on Aug. 4, 1953 for "Football Target Game Apparatus" (hereafter the "Kenney patent");

3. U.S. Pat. No. 4,245,843 issued to Denis O. Griggs on Jan. 20, 1981 for "Hockey Target" (hereafter the "Griggs patent");

4. U.S. Pat. No. 4,295,648 issued to Theodore D. Stromback on Oct. 20, 1981 for "Baseball Pitcher's Target" (hereafter the "Stromback patent");

5. U.S. Pat. No. 4,826,166 issued to Richard M. Baker et al. on May 2, 1989 for "Football Target Assembly" (hereafter the "Baker patent");

6. U.S. Pat. No. 4,842,283 issued to Kenneth LeBel et al. on Jun. 27, 1989 for "Target Assembly" (hereafter the "LeBel patent");

7. U.S. Pat. No. Des. 303,824 issued to William J. Maloney, II on Oct. 3, 1989 for "Soccer Goal" (hereafter the "Maloney patent");

8. U.S. Pat. No. 4,948,147 issued to Michel Pallanca on Aug. 14, 1990 for "Soccer Target" (hereafter the "Pallanca patent");

9. U.S. Pat. No. 4,984,809 issued to Hsi-Shih Chiang on Jan. 15, 1991 for "Ball Game Device" (hereafter the "Chiang patent");

10. U.S. Pat. No. 5,181,725 issued to Nicholas J. Leras et al. on Jan. 26, 1993 for "Soccer Shooting Training Target" (hereafter the "Leras patent");

11. U.S. Pat. No. 5,503,402 issued to Norman R. Moss, Jr. on Apr. 2, 1996 for "Soccer Practice Focal Device" (hereafter the "Moss patent");

12. U.S. Pat. No. 5,888,153 issued to James Steven Masin on Mar. 30, 1999 for "Portable Shot Target Assembly" (hereafter the "Masin patent");

13. U.S. Pat. No. 6,209,876 issued to Kevin Franklin on Apr. 3, 2001 for "Football Target Game" (hereafter the "Franklin patent");

14. U.S. Pat. No. 6,402,641 issued to William J. Lee on Jun. 11, 2002 for "Movable Target For Sports Goal" (hereafter the "Lee patent");

15. United States Published Patent Application No. 2002/0111234 to Kevin MacNichol on Aug. 15, 2002 for "Sports Practice Net For Arresting Flying Projectile Objects" (hereafter the "MacNichol Published patent application");

16. U.S. Pat. No. 6,508,729 issued to Warren V. Coltrane et al. on Jan. 21, 2003 for "Goal Shot Training System" (hereafter the "Coltrane patent");

17. U.S. Pat. No. 6,692,384 issued to Shelley Bains on Feb. 17, 2004 for "Apparatus for Defining Goal Target Area" (hereafter the "Baths patent");

18. U.S. Pat. No. 7,134,976 issued to Paul D. Smith on Nov. 14, 2006 for "Sports Training Device And Method of Using The Same" (hereafter the "Smith patent");

19. U.S. Pat. No. D537,489 issued to Kevin M. McAdams et al. on Feb. 7, 2007 for "Target" (hereafter the "McAdams Design patent");

20. U.S. Pat. No. 7,252,604 issued to Arthur Birss on Aug. 7, 2007 for "Target Apparatus For A Sport Goal" (hereafter the "Birss patent");

21. United States Published Patent Application No. 2008/0272548 to Glenn Brant Hensley on Nov. 6, 2008 for "Target Hanger And Target Support System" (hereafter the "Hensley Published patent application");

22. United States Published Patent Application No. 2009/0176603 to Donnie Travis Prince on Jul. 9, 2009 for "Soccer Training Target, Method For Practicing Kicking Using Same, And Method For Advertising Using Same" (hereafter the "Prince Published patent application");

23. U.S. Pat. No. 7,661,679 to Ernest Wing Mah et al. on Feb. 16, 2010 for "Electronic Target System For Sports" (hereafter the "Mah patent").

The Morgan patent involves a game which represents a multiplicity of rings to shoot at as a target or to aim it as a target as described.

The Kenney patent essentially is a target for practice through which a ball may be thrown or kicked. The structure is essentially on the ground and as best illustrated from the side view, has a rectangular shaped board 10 having an opening 12 through which the ball can be thrown and kicked. Behind the structure is a netting 28 through which the ball can fall through to be retrieved.

The Griggs patent discloses a hockey target which is affixed to the side of a hockey net by the affixing means shown in FIG. 2. There is a goal through which the hockey puck is intended to be kicked. The hockey net is obviously closer to the ground and this can be affixed to the side of the hockey net post by simple manual means.

The Stromback patent discloses a baseball pitchers target. Specifically, the target is a donut shaped member 12 hung from a string 11 and placed in what is typically known as a "strike zone". Clearly, the target is in the mid section of the strike zone. Specifically, the patent discloses:

> "Within the strike zone 6 of the preferred embodiment 1 is suspended a circular target 12. The target 12 which is ancillary to the strike zone 6 is supported by a cord 11 which is attached by a simple knot to the target 12 and upper cross-member 2. Target 12 can be repositioned within the zone 6 by moving its point of attachment to member 2 and lengthening or shortening cord 11, for the purpose of designating a particular area of the zone 6, such as, the inside or outside corner."

The Baker patent discloses a football target practice member which includes having a boom 16 so that the target can be moved to different locations and repositioned after the ball has been thrown through the target. In concept this embodies the general concept of having a target for a football but it is not specifically focusing on soccer and the target can be on any type of structure as the goal is to present a moving target which can be repositioned so that a football can be thrown through the target.

The LeBel patent deals with creating targets for a hockey goal post and they can be fixed to the goal posts as shown in FIG. 1. Clearly, the targets are at the four corners and it is shown that the hockey puck can be hit to aim for one of the four posts. However, because the hockey goal itself is shorter than human height, it is easy to simply stand adjacent it and to affix the solid target at any location on the posts of the hockey goal.

The Maloney patent is a design patent which discloses the concept of having a target affixed to the top posts of a structure to form a soccer goal but there is no indication that this is part of a soccer post arrangement and simply appears to be an arranged post so that someone can kick a soccer ball through the central goal.

The Pallanca patent discloses a large framework for providing soccer targets at different locations including the upper left and upper right portion as shown in FIG. 1. However, this is a very cumbersome device which needs to be affixed with posts and probably takes a substantial amount of time to set up.

The Chiang patent discloses a ball game device which contains a target with a receiving end on the bottom so that the ball can fall into the net after it goes through the target.

The Leras patent discloses:

"A soccer shooting training target which may be easily rolled up and transported can be installed over an existing soccer goal. The target comprises a plurality of individual targets containing flaps sized to admit passage to a soccer ball. The soccer shooting training target's upper edge is tied in place to the goal rear crossbar using a weighted rope. The bottom corners of the soccer shooting training target are tied down using elastic cord and stakes in order to render the target stable in the presence of wind. Alternate soccer shooting training target configurations include a stand mounted free standing version and a canister housed target permanently mounted to a soccer goal crossbar."

The Moss patent discloses a soccer practice apparatus which in broad concept focuses on placing on a soccer goal a target in the upper left and upper right quadrant as shown. However, the device is an L-shaped member 12 which is affixed by fastening means 22 and therefore the way the device is fastened requires time to attach it and disconnect it.

The Masin patent is a portable shot target device which can be affixed to a hockey goal post by a clamping device 18 to create a basket to shoot the hockey puck.

The Franklin patent discloses a football target game wherein a target is bolted to a frame assembly so that a football can be thrown through it.

The Lee patent discloses a movable target for a sports goal. Essentially it is a target that is suspended from the upper cross bar by movable straps 22 so that the target can be moved along the horizontal length of the goal.

The MacNichol Published patent Application discloses having a target suspended by two elastic suspension means 20 wrapped around the upper post.

The Coltrane patent discloses a goal shot training system where a multiplicity of straps are wrapped around the goal to break the goal into different sections for aiming a soccer or other ball.

The Bains patent discloses an apparatus for defining a target which contains a pair of telescoping members that have adjoining tubular members that are wrapped around right angle locations on the first and second section of a cross bar of a goal to form a target in the upper left or upper right portion of the goal.

The Smith patent discloses the concept of having multiple straps affixing targets at different locations in the soccer goal posts. The affixation method is described as follows:

"While a target device 100 may be removably attached to a soccer goal post, cross-bar or other rigid post in any number of ways, FIG. 1 shows the support member 160 ready for secure attachment to a rigid elongated strut 180 which then has multiple straps 200 attached thereto. The straps 200 provide a mechanism for attaching the target device 100 to a rigid post. The straps 200 incorporate a buckle 205, having a pin 210 and a series of strap openings 215 for receipt of the buckle pin 210 to permit the straps 200 to accommodate various post sizes. The strut 180 can also be clamped or similarly joined to a post or the like. In one embodiment, the cross-section of the strut 180 is generally shaped to conform to the exterior cylindrical shape of a post. In other words, the strut 180 may have a concave surface which generally matches the contour of a cylindrical post."

The McAdams patent discloses effectively hanging a target over the net but the hanging incorporates having a dumbbell shaped target so that it not only hangs over the upper cross bar but rests on the ground as well.

The Birss patent is still in full force and effect and is a target apparatus for a sports goal. The targets are mounted by mounting brackets on the various sides or behind the posts as illustrated.

The Hensley Published patent Application discloses hanging members 21 which serve to hang the target over a vertical post.

The Prince Published patent Application discloses a target which is effectively hooked to the mesh netting as shown in FIG. 1.

The Mah patent discloses an electronic target apparatus which is affixed to the side posts of a goal and has means to register a signal when an object has been shot through or kicked through the goal.

There is a significant need for an improved target apparatus which can be quickly removed from a soccer goal which target enables an individual to aim at certain specific desired areas which are the most difficult areas for a goalie to defend.

SUMMARY OF THE INVENTION

The present invention is a portable target which can be quickly and removably affixed to the top post of a soccer goal to provide a target to enable an individual to practice kicking the soccer ball in the upper left quadrant or the upper right quadrant of a soccer goal which are the most difficult portions of the goal for a goalie to defend.

The present invention enables an individual to stand on the ground and to lift the target over the goal posts and through an improved affixing hook, enables the target to be quickly affixed to the top horizontal crossbar of a goal post and moved to a specific location anywhere along the top horizontal crossbar, but preferably at a location so that the target is positioned in the upper right quadrant or the upper left quadrant of the soccer goal which are the most difficult locations for a goalie to defend.

The portable goal is designed with rods that enable an individual to stand on the ground and lift the portable target so that it can be lifted over the top horizontal crossbar of the soccer goal and then set in place. This is a significant improvement over prior art targets where an individual must stand on a ladder to affix the target to the soccer goal or alternatively the target cannot be quickly and removably affixed to the soccer goal but needs to be affixed by more permanent means with an individual standing on a ladder or other structure so they can reach the height of the upper portions of the soccer goal to affix the target thereto. The present invention eliminates this time consuming effort by having elongated rods with curved hook attaching members designed in a manner that enables an individual to stand on the ground and simply lift the target so that the curved hook attaching members can be extended over the top horizontal crossbar of a soccer goal and then lowered onto the top horizontal crossbar of a soccer goal to be removably affixed thereto. This saves a lot of time and effort in not requiring an individual to affix the target to a soccer goal in a more permanent manner and also eliminates the need to have ladders or other structures on which the individual must stand.

Therefore, the present invention significantly reduces the time that it takes to affix the target to the soccer goal and also enables the target to be very quickly removed from the soccer goal. Therefore, in addition to facilitating practice of kicking the soccer ball at any time when the game is not going to be played, it also provides a method to have an individual practice kicking the soccer ball immediately before a game and thereafter the target can be quickly removed before the game starts.

The present invention portable target can be quickly disassembled and carried in a carrying bag or pouch and then quickly assembled at the location of the soccer goal.

It has been discovered, according to the present invention, that if a soccer target is made out of flexible material and if the flexible material has a pair of receiving openings at either transverse end to receive a longitudinal shaft having a hook connecting member at its upper end, then the target can be easily placed over the upper horizontal crossbar of a soccer goal because the target is of sufficient height that an individual can stand on the ground and raise the target above his head until the hooked ends of the attaching members rest over the horizontal crossbar of the soccer goal and then can be lowered so that the hook members retain the target on the upper horizontal crossbar at any desired location.

It has also been discovered that if the leading edge of each hook has a rounded end, then this facilitates placing the hook over the top of the horizontal crossbar of the soccer goal in a more efficient and quick manner.

It is therefore an object of the present invention to provide a portable target which can be removably affixed to the top horizontal crossbar of a soccer goal by an individually stand on the ground in front of the soccer goal and raising the target so that the curved hook ends of the oppositely disposed target retaining rods can be positioned above the horizontal crossbar and then lowered so that the curved hook members are removably affixed onto the horizontal crossbar over the soccer goal with the target being positioned at any desired location along the top of the soccer goal, and preferably adjacent to one vertical post of the soccer goal so that the target is in the upper left quadrant or the upper right quadrant of the soccer goal.

It is a further object of the present invention to provide a means by which the removable target can be affixed to a soccer goal without requiring the use of a ladder or any other elevational apparatus which requires an individual to be elevated above the ground to affix the target to the soccer goal and which enables an individual to stand on the ground and removably affix the target to the soccer goal to thereby enable the target to be quickly affixed and removed as needed.

It is an addition object of the present invention to provide a pair of hook members each having a rounded leading edge to facilitate the placement of the target retaining hook members onto the top horizontal crossbar of the soccer goal and also facilitate the removal of such target retaining hook members when the target is no longer needed.

It is to be understood that both the foregoing general description and the following detailed description are exemplary and explanatory only and are not restrictive of the invention as claimed.

The accompanying drawings which are incorporated in and constitutes a part of the specification, illustrate one embodiment of the invention and together with the description, serve to explain the principles of the invention.

Further novel features and other objects of the present invention will become apparent from the following detailed description, discussion and the appended claims, taken in conjunction with the drawings.

DRAWING SUMMARY

Referring particularly to the drawings for the purposes of illustration only and not limitation therein is illustrated:

DETAILED DESCRIPTION OF THE PREFERRED EMBODIMENTS

Figure 1:
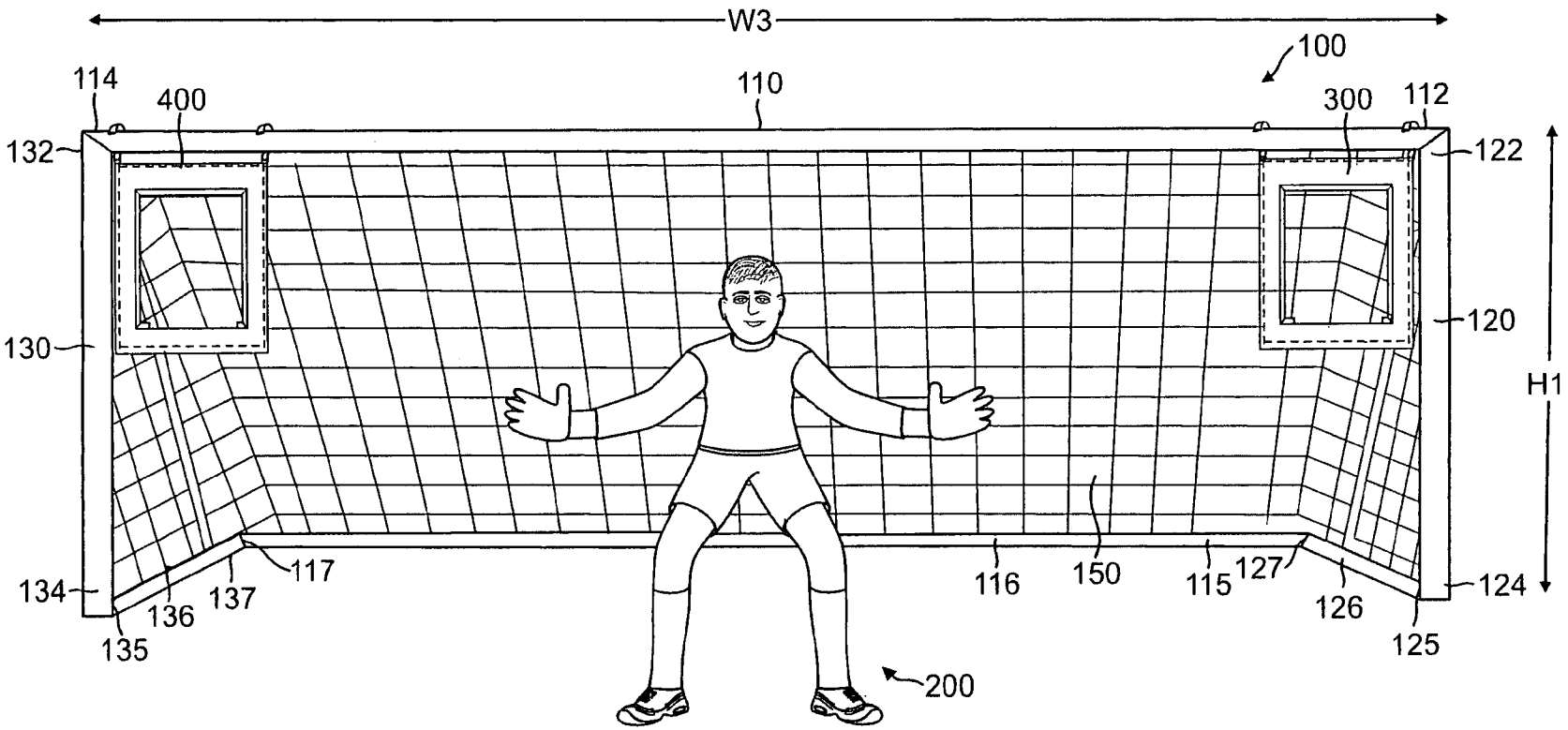
FIG. 1 is front perspective view of a soccer goal with a goalie standing in front of the soccer goal and two targets of the present invention removably affixed to the top horizontal crossbar of the soccer goal at the upper left quadrant and the upper right quadrant which are the most difficult locations for a goalie to defend.
Figure 2:
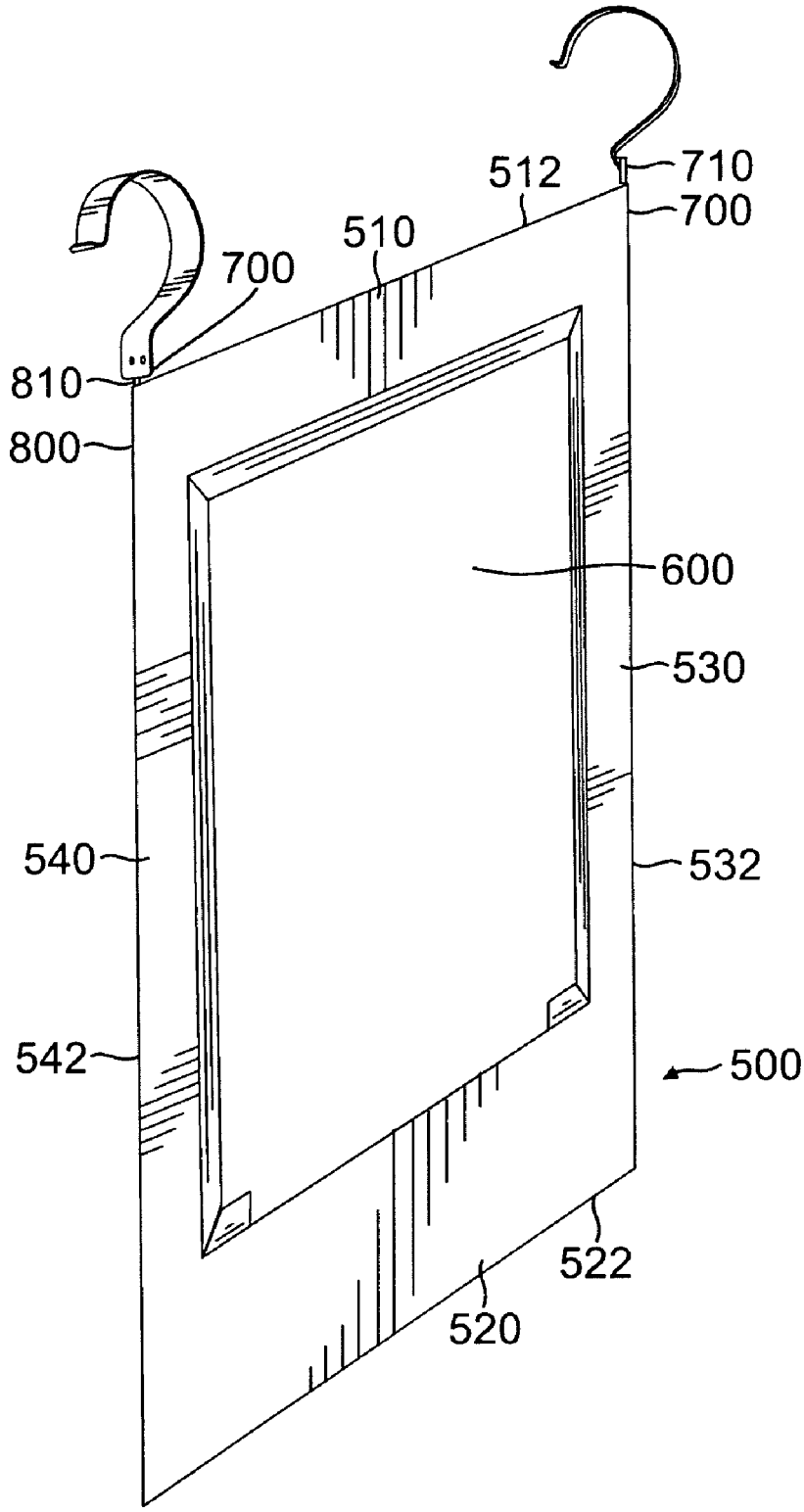
FIG. 2 is a perspective view of the present invention portable target.
Figure 3:
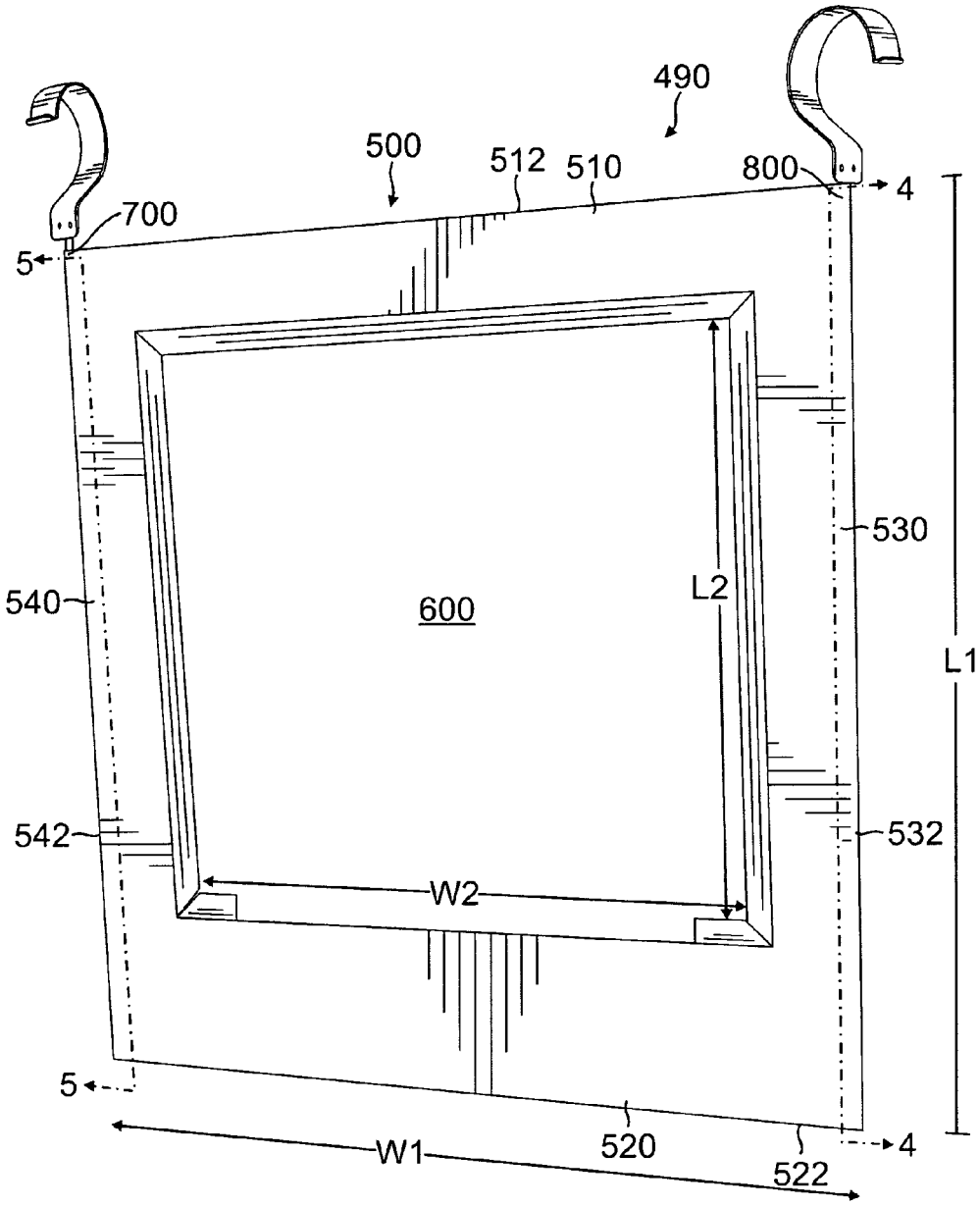
FIG. 3 is a front elevation view of the present invention portable target.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 2 through 6, there is illustrated the present invention portable target 490 for use with a soccer goal. Specifically, the present invention comprises a flexible frame 500. A preferred embodiment of the flexible frame 500 is to be generally square or rectangular in shape having an upper wall 510 with a top edge 512, a parallel lower wall 520 with a bottom edge 522, a first longitudinal side wall 530 with a first lengthwise side 532, and a second longitudinal side wall 540 with a second lengthwise side 542 which enclose the interior target 600 which can either be rectangular, square, circular, oval or any other desired shape. The preferred material for the target frame 500 is a flexible fabric material although it is within the spirit and scope of the present invention for the target frame 500 to be made of any other portable light weight but strong material.

Figure 4:
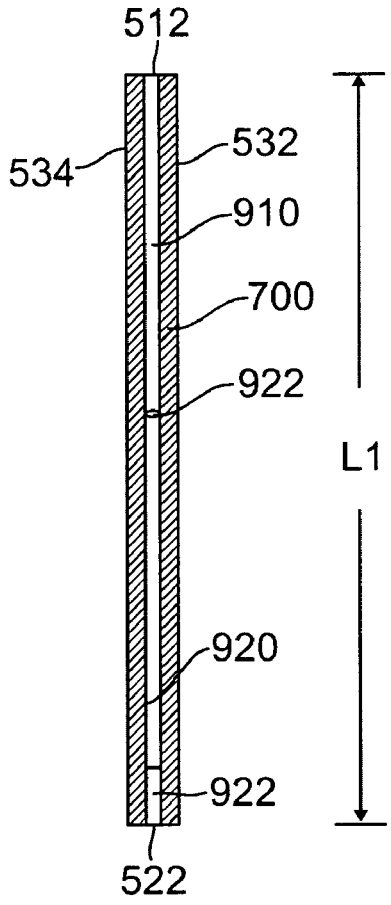
FIG. 4 is a cross-sectional view taken along line 4-4 of FIG. 3.
Figure 5:
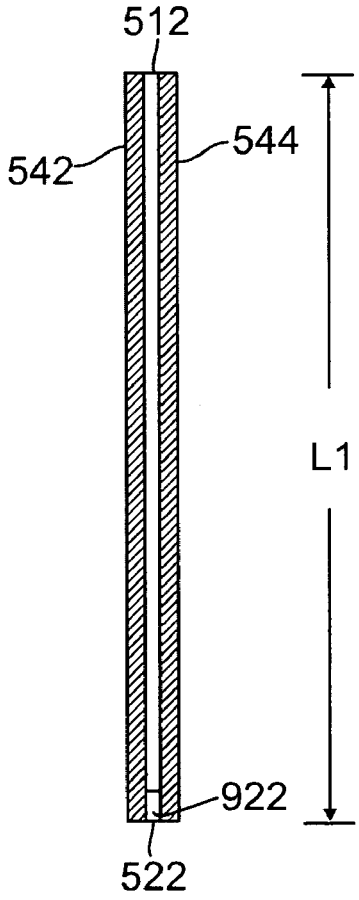
FIG. 5 is a cross-sectional view taken long line 5-5 of FIG. 4.

The frame 500 contains an interior channel on either lengthwise side. Referring to FIG. 4, first side wall 530 contains an interior lengthwise channel 700 which extends from the top edge 512 of upper wall 510 to the bottom edge 522 of lower wall 520 with the channel 700 extending through the entire vertical length "L1" of the first longitudinal section 530. Similarly, there is a parallel oppositely disposed second interior channel 800 which extends from the top edge 512 of the upper wall 512 to the bottom edge 522 of the lower wall 520 with the channel 800 extending through the entire vertical length "L1" of the second longitudinal section 520.

By way of example, the exterior dimensions of the frame 500 can be a height or length "L1" of approximately 41 inches and a width "W1" of approximately 36 inches. The interior target can have a height or length "L2" of approximately 29 inches and a width of approximately 27½ inches. This is assuming that the soccer goalpost itself has a horizontal width "W3" of approximately 24 feet and has a height "H1" of approximately 8 feet.

Figure 6:
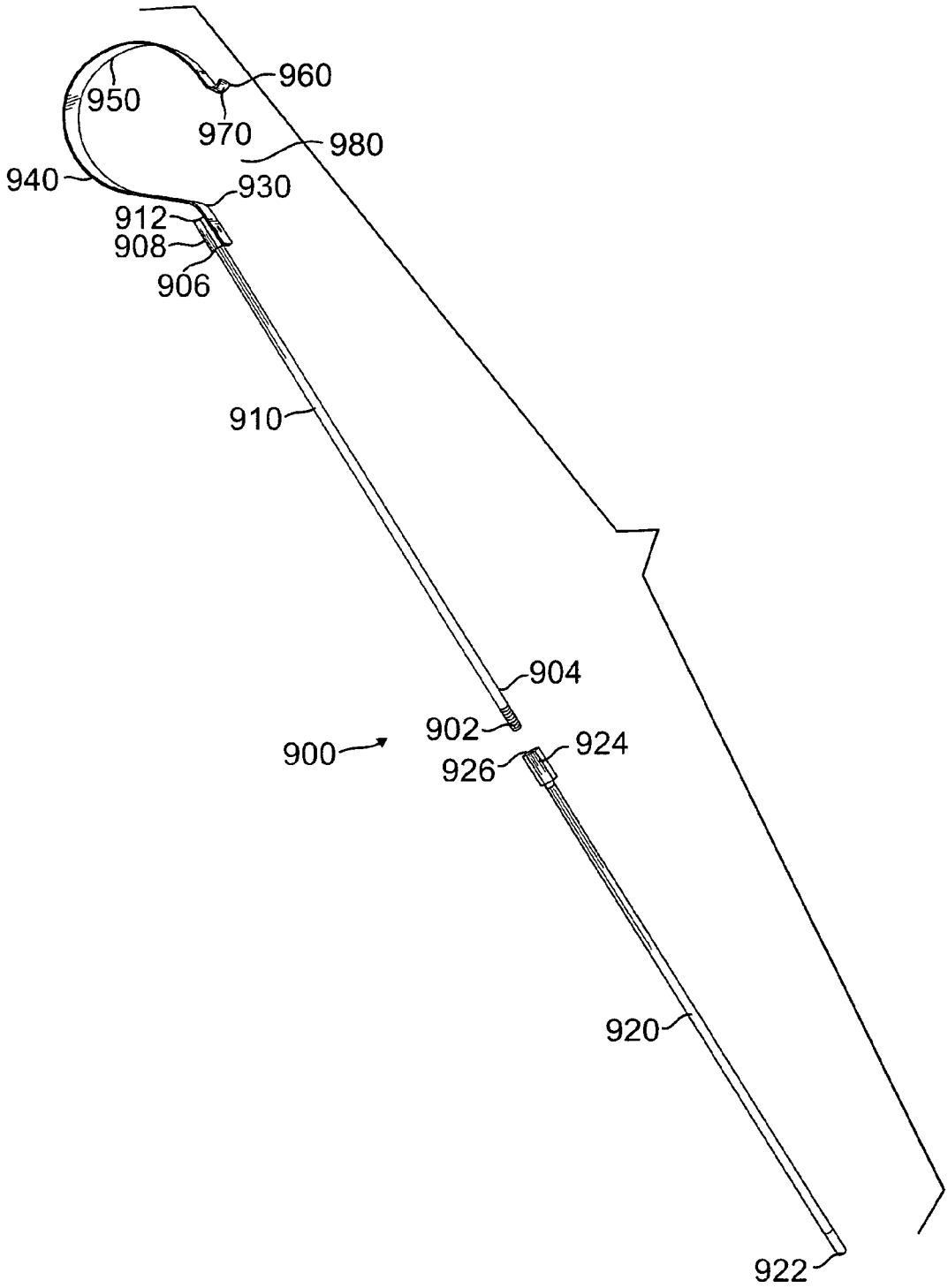
FIG. 6 is an exploded side view of two sections of the longitudinal connecting rod which is used in the present invention.
Figure 7:
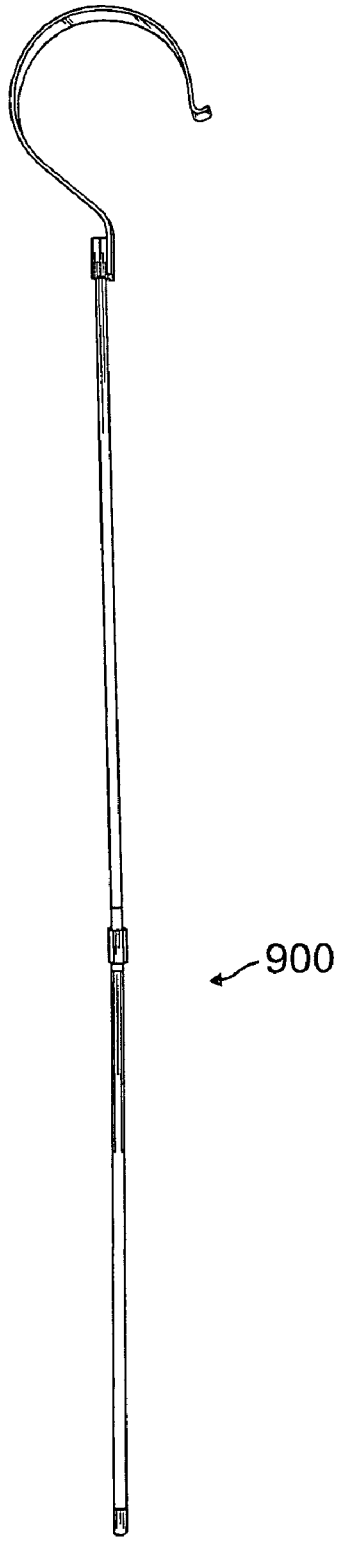
FIG. 7 is a side elevational view of one of the connecting rods of the present invention.

Received within each channel 700 and 800 is a connecting rod 900. Referring to FIGS. 6 and 7, to facilitate portability of the target and its connecting rods, the connecting rod 900 is preferably made in at least two separate sections such as a first section 910 and a second section 920 which can be interconnected by mating fastening members. By way of example, first section 910 can have a threads 902 at one distal end 904 and the second section 920 can have a connecting member 924 having internal female threads 926 to receive the threads 902 from first section 910 so that the two sections of the connecting rod 900 can be rotatably affixed together.

Connected at the proximal end 906 of first connecting rod section 910 is a flexible connecting member 908 which receives a curved hook retaining member 940. At its proximal end 930 the hook retaining member 940 is retained onto the connecting member 908 by rivets or other affixation means. The hook retaining member 940 comprises a generally arc shaped section 950 which terminates in a rounded transverse tip 960. The curved retaining hook 940 has an interior retaining opening 970 which is surrounded for approximately three quarters of its circumference by arc shaped section 950. An opening 980 between transverse tip 960 and proximal end 930 leads to interior retaining opening 970. This illustration assumes that the top horizontal crossbar 110 of the soccer goalpost is round. It will be appreciated that the top horizontal crossbar 110 of the soccer goalpost can have any cross-sectional shape which includes round, square, rectangular etc. Therefore, the hook retaining member 940 will have a section 950 which has a shape which conforms to the cross-sectional shape of the top horizontal crossbar 110 of the soccer goalpost.

One key aspect of the present invention is the design of the hook member 940. Currently, the hook is made of metal which is thin enough to allow it to bend (flexible) to expand when needed to be pulled or snapped over the top horizontal crossbar 110 of the soccer goalpost 100 when in use or released or pushed off the top crossbar after use, whether the crossbar is round, square or even rectangular. Soccer goal posts are manufactured with round bars, square bars and even rectangular bars. Furthermore, the diameter of the bars being used to construct the soccer goals are varying dimensions. Therefore, the interior section 950 of the hook 940 will have a diameter that conforms to the cross-sectional shape of the horizontal crossbar so that it can be snapped in place over the horizontal crossbar. The transverse lip 960 on the end of the hook of the flexibility of the metal together allow the target to be used on types and sizes of soccer goals.

As illustrated in FIG. 4, a first connecting rod 900 has its bottom end 922 resting adjacent lower edge 522 and extends the entire length "L1" of channel 700. An interior lengthwise wall 534 encloses the length of channel 700 so that first connecting rod 900 rests within channel 700 between first side wall 932 and interior lengthwise wall 934. The channel 700 has a top opening 710 extending out of top edge 512 so that the distal end 906 of rod section 910 extends out of the opening 710 so that hook retaining member 940 is positioned above top end 512 of top edge 510 of frame 500.

As illustrated in FIG. 4, a second identical connecting rod 900 has its bottom end 922 resting adjacent lower edge 522 and extends the entire length "L1" of channel 800. An interior lengthwise wall 544 encloses the length of channel 800 so that second identical connecting rod 900 rests within channel 800 between second side wall 942 and interior lengthwise wall 944. The channel 800 has a top opening 810 extending out of top edge 512 so that the distal end 906 of rod section 910 extends out of the opening 810 so that hook retaining member 940 is positioned above top end 512 of top edge 510 of frame 500.

The flexible material of the frame 500 is sufficient tight so that the connecting rods 900 are retained by a press fit within the respective channels 700 and 800 of frame 500. It is also within the spirit and scope of the present invention to have additional fastening members at the top of connecting rod 900 to fasten the connecting rods to the frame 500.

The entire apparatus in illustrated in place on a soccer goal in FIG. 1. The soccer goal 100 comprises a first vertical post 120, a second vertical post 130 and an upper horizontal crossbar 110. Horizontal crossbar 100 has a first end 112 and a second end 114. First vertical post 120 has a top end 122 and a bottom end 124. Second vertical post 130 has a top end 132 and a bottom end 134. The soccer goal 100 also includes a first transverse bottom wall 126 having a front end 125 and a rear end 127. The soccer goal 100 also includes a second transverse bottom wall 136 having a front end 125 and a rear end 137. The soccer goal 100 also includes a lower horizontal wall 116 having a first end 115 and a second end 117.

Top horizontal crossbar 110 is connected at its first end 112 to the top end 122 of first vertical post 120 and connected at its second end 114 to the top end 132 of second vertical post 130. Lower horizontal wall 116 is connected at its first end 115 to rear end 127 of first transverse bottom wall 126 and connected at its second end 117 to the rear end 137 of second transverse bottom wall 136. The first vertical post 120 is connected at its bottom end 124 to front end 125 of first transverse bottom wall 126 and second vertical post 130 is connected at its bottom end 134 to the front end 135 of second transverse bottom wall 136.

The soccer net 150 is retained by top horizontal crossbar 110, first vertical post 110, first transverse bottom wall 126, second vertical post 130, second transverse bottom wall 136, and lower horizontal wall 116. A goalie 200 is shown in position in front of the soccer goal 100.

The present invention portable target 490 is removably affixed to the top crossbar 110 of the soccer goal 100 by an individual standing on the ground and lifting the frame 500 of the portable target 490 so that the curved hook sections 540 of each of the connecting rods 900 extends above the upper crossbar 110 and the rounded transverse tip 960 of each of the curved hook second 540 is placed over the top horizontal crossbar 110. Entry into the interior retaining opening 570 is gained by passing opening 580 over top horizontal crossbar 110 with the rounded transverse tip 960 facilitating passage of the opening 970 over the top horizontal cross-bar 100 so that the horizontal crossbar rests within interior retaining opening 970 of each curved hook section 940 of each retaining rod 900.

In FIG. 1, the curved hook sections 940 are oriented so that the rounded transverse tip faces the front of the soccer goal 100. It is also within the spirit and scope of the present invention for the target 490 to be orientated in the opposite way so that the rounded transverse tip 960 faces the rear of the soccer goal 100.

Once the rounded tips 960 come in contact with the top horizontal crossbar 110 of the soccer goal 100, it is easy to slip the curved hook sections 940 over the top of the top horizontal crossbar 110 and have them remain in place. The rounded interior 970 of each curved connecting hook 940 easily accommodates the top crossbar 110 of the soccer goal 100. The benefit of the present invention is that an individual does not have to stand on a ladder or any other elevated structure but can stand on the ground and lift the portable target 490 so that the connecting hooks 940 of the connecting rods 900 rise over the top crossbar 110 and then the target 490 is lowered so that the connecting hooks 940 can be lowered over the top horizontal crossbar of the soccer goal 100 and rest in place.

The present invention enables even a child in addition to an adult to easily place and remove the soccer goal over the horizontal crossbar of a soccer net. Therefore, this target can be used by children and adults of all ages. Even a child can easily assemble the target and then hold the target from the bottom of the poles and lift it into place over any size goal without any assistance and when finished, be able to push the target off the crossbar and disassemble the target and place it back into a carrying bag.

A further benefit of the present invention is that the targets 490 can be located in the upper right quadrant and the upper left quadrant of a soccer goal 100 so that the interior target 600 is presented at these locations which are the most difficult locations for a goalie to defend. By being able to quickly and removably affix the target 490 in this manner, practice can be done at any time even immediately before a game since the target 490 can be quickly removed right before the game starts. The individual practices kicking a soccer ball through the interior target 600. In FIG. 1 targets 490 are illustrated in both the upper right quadrant and the upper left quadrant. In general, only one target 490 is used and positioned at either of these locations. However, it is within the spirit and scope of the present invention for the present invention to have two or more targets in use at the same time. The target 490 can be located at any location on the top horizontal crossbar.

Of course the present invention is not intended to be restricted to any particular form or arrangement, or any specific embodiment, or any specific use, disclosed herein; since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A portable target for use with a soccer goal having at least a first vertical post, a second vertical post, and an upper horizontal crossbar, and a retaining a soccer net, the portable target comprising:

a. a flexible frame made of flexible fabric material and having an upper wall with a top edge a parallel lower wall with a bottom edge, a first longitudinal side wall with a first lengthwise side, and a second longitudinal side wall with a second lengthwise side, the frame enclosing an interior opening which functions as a target;

b. the flexible frame having a first interior lengthwise channel adjacent first longitudinal sidewall and having an opening at the top edge and extending from the top edge of the upper wall to the bottom edge of lower wall and terminating in a closed end at the bottom edge of the lower wall;

c. the flexible frame having a second interior lengthwise channel adjacent second longitudinal sidewall and having an opening at the top edge and extending from the top edge of the upper wall to the bottom edge of lower wall and terminating in a closed end at the bottom edge of the lower wall;

d. a first connecting rod made in at least two separate sections which are interconnected by mating fastening members to form an elongated rod having a top end and a bottom end, a connecting member retained at the top end of the first connecting rod, the connecting member in the shape of an arcuate curved hook surrounding an arcuate opening, the curved hook terminating in a rounded transverse tip, the first connecting rod received in and retained in the first interior lengthwise channel so that the bottom of the rod rests adjacent the closed end of the first interior lengthwise channel and the connecting hook extends out of the top opening of the first interior lengthwise channel;

e. a second connecting rod made in at least two separate sections which are interconnected by mating fastening members to form an elongated rod having a top end and a bottom end, a connecting member retained at the top end of the second connecting rod, the connecting member in the shape of an arcuate curved hook surrounding an arcuate opening, the curved hook terminating in a rounded transverse tip, the second connecting rod received in and retained in the second interior lengthwise channel so that the bottom of the rod rests adjacent the closed end of the second interior lengthwise channel and the connecting hook extends out of the top opening of the second interior lengthwise channel; and f. the portable target removably affixed to the top crossbar of the soccer goal by an individual standing on the ground and lifting the flexible frame of the portable target so that the curved hook sections of each of the connecting rods extends above the upper crossbar and the rounded transverse tip of each of the curved hook section is placed over the top horizontal crossbar to facilitate insertion of a portion of the top crossbar into each arcuate opening, of each curved hook section of each retaining rod, the target of sufficient size so that an individual does not have to stand on a ladder or any other elevated structure but can stand on the ground and lift the portable target so that the connecting hooks of the connecting rods rise over the top crossbar, and then the target is lowered so that the connecting hooks are lowered over the top horizontal crossbar of the soccer goal and rest in place.

2. The portable target in accordance with claim 1 wherein the opening is selected from the group consisting of square, rectangular, oval and round.

3. The portable target in accordance with claim 1 wherein each retaining rod is respectively retained in an interior channel in the target by a press fit.

4. The portable target in accordance with claim 1 wherein the connecting rods are easily disassembled and the target folded up and the target and disassembled connecting rods carried in a portable container.

5. A portable target for use with a soccer goal having at least a first vertical post, a second vertical post, and an upper horizontal crossbar of a given cross-sectional shape, and a retaining a soccer net, the portable target comprising:

a. a flexible frame made of flexible material and having an upper wall with a top edge, a parallel lower wall with a bottom edge, a first longitudinal side wall with a first lengthwise side, and a second longitudinal side wall with a second lengthwise side, the frame enclosing an interior opening which functions as a target;

b. the flexible frame having a first interior lengthwise channel adjacent first longitudinal sidewall and having an opening at the top edge and extending from the top edge of the upper wall to the bottom edge of lower wall and terminating in a closed end at the bottom edge of the lower wall;

c. the flexible frame having a second interior lengthwise channel adjacent second longitudinal sidewall and having an opening at the top edge and extending from the top edge of the upper wall to the bottom edge of lower wall and terminating in a closed end at the bottom edge of the lower wall;

d. a first elongated connecting rod having a top end and a bottom end, a flexible connecting member retained adjacent the top end of the first connecting rod, the flexible connecting member in a shape having an opening to match the cross-sectional shape of the upper horizontal crossbar and extending to a hook terminating in a rounded transverse tip, the first connecting rod received in and retained in the first interior lengthwise channel so that the flexible connecting hook extends out of the top opening of the first interior lengthwise channel;

e. a second elongated connecting rod having a top end and a bottom end, a flexible connecting member retained adjacent the top end of the second connecting rod, the flexible connecting member in a shape having an opening to match the cross-sectional shape of the upper horizontal crossbar and extending to a hook terminating in a rounded transverse tip, the second channel so that the flexible connecting hook extends out of the top opening of the second interior lengthwise channel; and f. the portable target removably affixed to the top crossbar of the soccer goal by an individual standing on the ground and lifting the flexible frame of the portable target so that the hook sections of each of the connecting rods extends above the upper crossbar and the rounded transverse tip of each curved hook section is placed over the top horizontal crossbar to facilitate insertion of a portion of the top crossbar into each opening of each curved hook section of each retaining rod, the target, of sufficient size so that an individual does not have to stand on a ladder or any other elevated structure but can stand on the ground and lift the portable target so that the connecting hooks of the connecting rods rise over the top crossbar.

6. The portable target in accordance with claim 5 wherein the opening is selected from the group consisting of square, rectangular, oval and round.

7. The portable target in accordance with claim 5 wherein each retaining rod is respectively retained in an interior channel in the target by a press fit.

8. The portable target in accordance with claim 5 wherein the target is folded up and carried in a portable container.

9. A portable target for use with a soccer goal having at least first vertical post, a second vertical post, and an upper horizontal crossbar of a given cross-sectional shape, and a retaining a soccer net, the portable target comprising:

a. a flexible frame made of flexible material and having at least a first longitudinal side wall with a first lengthwise side and a second longitudinal side wall with a second lengthwise side, the frame enclosing an interior opening which functions as a target;

b. the flexible frame having a first interior lengthwise channel adjacent first longitudinal sidewall, the first interior channel having an open top and a closed bottom;

c. the flexible frame having a second interior lengthwise channel adjacent second longitudinal sidewall, the second interior channel having an open top and a closed bottom;

d. a first elongated connecting rod having a top end, a flexible connecting member retained adjacent the top end of the first connecting rod, the flexible connecting member having an opening in a shape to match the cross-sectional shape of the upper horizontal crossbar and terminating in a hook, the first connecting rod received in and retained in the first interior lengthwise channel so that the hook extends out of the top opening of the first interior lengthwise channel;

e. a second elongated connecting rod having a top end, a flexible connecting member retained adjacent the top end of the second connecting rod, the flexible connecting member having an opening in a shape to match the cross-sectional shape of the upper horizontal crossbar and terminating in a hook, the second connecting rod received in and retained in the second interior lengthwise channel so that the connecting hook extends out of the top opening of the second interior lengthwise channel; and f. the portable target removably affixed to the top crossbar of the soccer goal by an individual standing on the ground and lifting the flexible frame of the portable target so that the hook sections of each of the flexible connecting rods extends above the upper crossbar so that a portion of the top crossbar is inserted into each opening of each hook section of each retaining rod, the target of sufficient size so that an individual is able to affixed the target while standing the ground and lift the portable target so that the connecting hooks of the connecting rods rise over the top crossbar, and then the target is lowered so that the connecting hooks are lowered over the top horizontal crossbar of the soccer goal and rest in place.

10. The portable target in accordance with claim 9 wherein the opening is selected from the group consisting of square, rectangular, oval and round.

11. The portable target in accordance with claim 9 wherein each retaining rod is respectively retained in an interior channel in the target by a press fit.

12. The portable target in accordance with claim 9 wherein each curved hook terminates in a rounded transverse tip.

* * * * *